United States Patent [19]

Sweeney

[11] 4,050,680

[45] Sept. 27, 1977

[54] CUTTING TORCH ARRANGEMENT

[75] Inventor: Patrick E. Sweeney, Baltimore, Md.

[73] Assignee: AAI Corporation, Cockeysville, Md.

[21] Appl. No.: 628,009

[22] Filed: Nov. 3, 1975

[51] Int. Cl.[2] ..... B23K 7/10

[52] U.S. Cl. ..... 266/48; 148/9 R; 431/99

[58] Field of Search ..... 431/99; 266/48; 148/9 R; 110/1 A, 1 R

[56] References Cited

U.S. PATENT DOCUMENTS

| | | | |
|---|---|---|---|
| 3,507,230 | 4/1970 | Seib | 431/99 X |
| 3,588,303 | 6/1971 | Karrer | 431/99 X |

*Primary Examiner*—Roy Lake
*Assistant Examiner*—Paul A. Bell
*Attorney, Agent, or Firm*—Reginald F. Pippin, Jr.

[57] ABSTRACT

A cutting torch arrangement is disclosed, including a thermal bar having a metal burner pipe with rod-like metal elements therein and gas passageways formed between these elements. A shroud/shield is disposed around the thermal bar, with an open shroud/shield end laterally spaced from the thermal bar. A spring-biased feeder assembly and shroud/shield biasing assembly is provided for yieldably urging the thermal bar forward within the shroud/shield and for retaining the shroud/-shield against a target. A cluster arrangement of thermal bars is also provided.

11 Claims, 5 Drawing Figures

CUTTING TORCH ARRANGEMENT

This invention relates to thermal bar cutting torch arrangements, and more particularly to a thermal bar cutting torch arrangement having a shroud/shield, and a thermal bar cutting torch arrangement having a spring biased holder/feeder.

Deflagrating metallic cutting torches are disclosed in U.S. Pat. No. 3,260,076, and are now commercially available, being commonly referred to as thermal bars or burner bars. These thermal bars conventionally consist of a burner pipe having a plurality of metallic rod-like elements packed therein, in the form of rods and/or wires, with longitudinal gas passageways formed in the voids between the rods, wires and pipe wall for passage of oxygen therealong. The rods are variable in number and material content, and conventionally are formed as a central burning accelerator rod of material such as magnesium alloy, magnesium/aluminum alloy, or aluminum, and surrounding rods or wires of steel such as 1068 steel. The burner pipe is normally mild steel. While particularly useful with such thermal bars, the present invention is, however, useful with other consumable thermal bar constructions and materials, such as plastic or other metal thermal bar constructions.

These consumable thermal bars offer substantial advantages over conventional gas cutting torch arrangements, including very rapid cutting and a minimal or reduced heat-affected zone around the hole or kerf of the cut. A number of applications heretofore considered very difficult if not impossible with conventional oxy-acetylene cutting torches are now achievable with relative ease with these thermal bars.

In utilizing the thermal bars, it is normal practice for the operator to wear special nonflammable protective clothing. In some instances it may be desirable to be able to utilize the thermal bars without the requirement for such protective clothing. In addition, in various special armed forces and intelligence applications it is desirable that the thermal bars be employed with suppressed, if not full, elimination of lateral visibility of the flame during the cutting of a given target by the thermal bar.

It is also desirable to provide a holding and feeding mechanism which will enable the thermal bar to be resiliently pressed against a given target and maintained against the target during the cutting operation. Likewise, it is desirable to provide such a feed mechanism which will also retain a flame visibility suppressant device against the target as the thermal bar is burned and fed to the zone of target cutting.

It is accordingly an object and feature of the present invention to provide an improved thermal bar cutting torch arrangement offering protection from back splatter of the thermal bar and target material during deflagration cutting by the thermal bar, and to thereby obviate the need for an asbestos or other protective suit or clothing presently required to be worn by the operator employing thermal bar cutting torch arrangements.

It is also an object and feature to protect the local area in the vicinity of the cutting operation, by confining the sparks and back splatter from the cutting zone.

It is still a further object and feature to suppress or materially reduce the likelihood of lateral visibility of the burning flame and cutting sparks produced during the cutting operation of a thermal bar arrangement.

Still another object and feature of the invention is the provision of an improved spring-biased feeding arrangement which enables the thermal bar to be resiliently held against a target and maintained against the cutting zone during the cutting operation.

Still a further object and feature is the provision of such a feeding arrangement in conjunction with a flame visibility and spark and back splash suppressor, which will also spring bias the suppressor against the target as the thermal bar is consumed and fed forwardly.

It is still a further object and feature of the invention to provide a cluster thermal bar arrangement which will be employed to enable cutting of a large target area than is feasible with a single pass of a single thermal bar.

Still other objects, features and attendant advantages will become apparent to those skilled in the art from a reading of the following detailed description of several physical embodiments constructed in accordance with the invention, taken in conjunction with the accompanying drawings, wherein.

Figure 1:
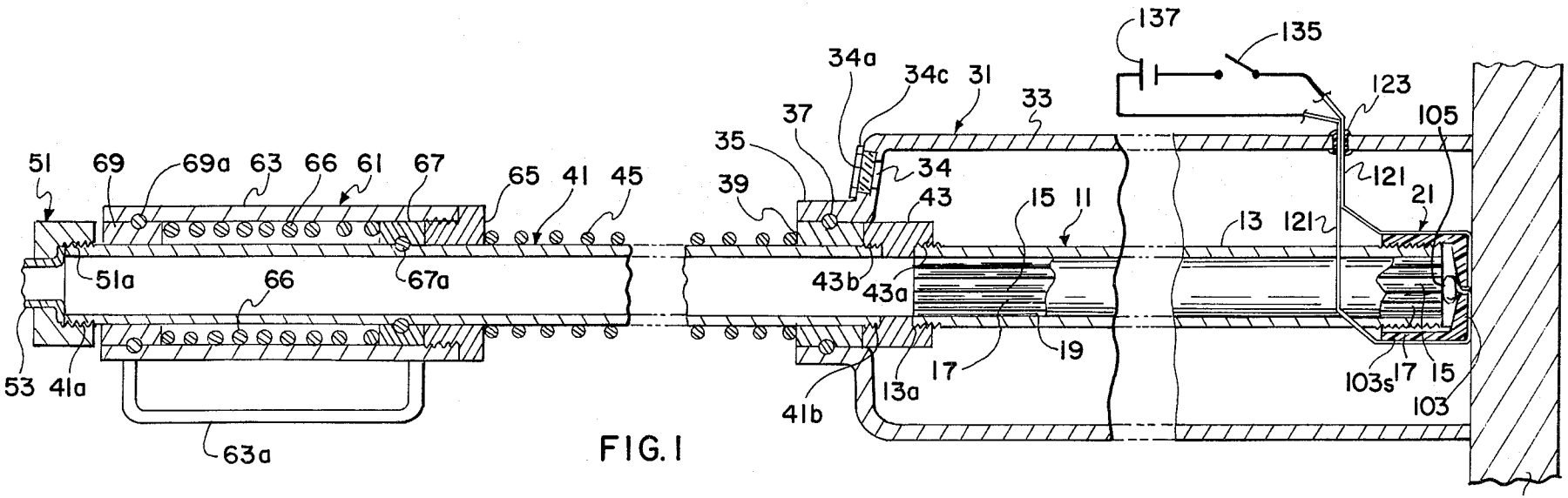
FIG. 1 is a longitudinal section view of a preferred embodiment constructed according to the invention.
Figure 2:
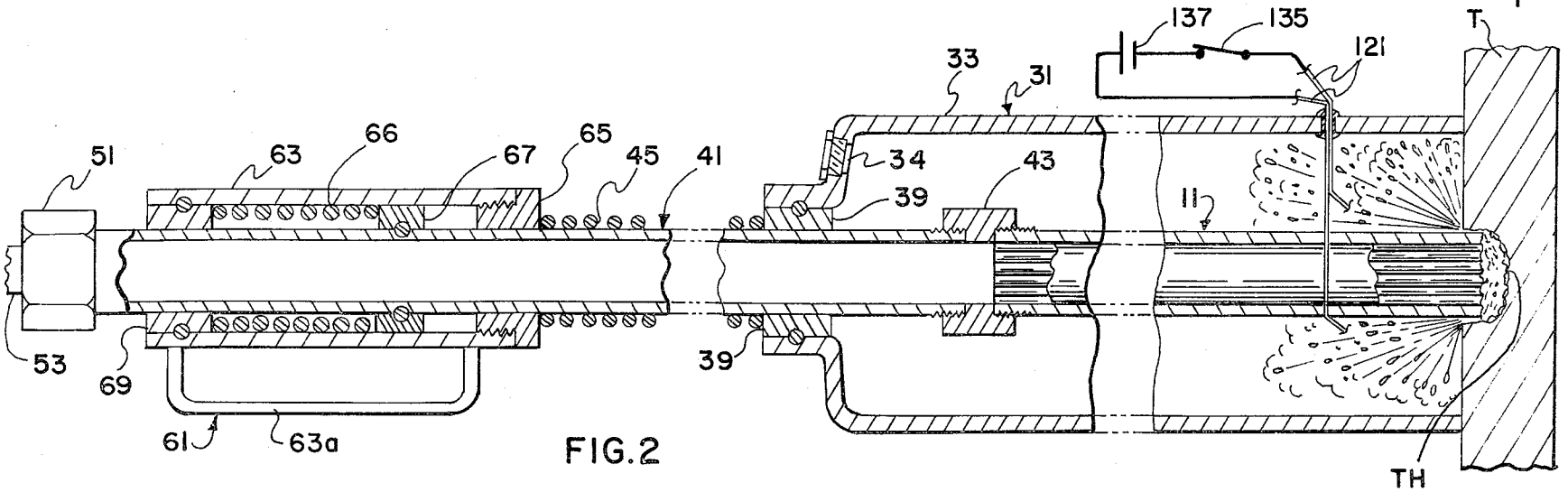
FIG. 2 is a longitudinal section view illustrating the operation of the embodiment of FIG. 1.

Referring now in detail to the Figures of the drawings, in the embodiment of FIGS. 1 and 2, a thermal bar 11 is provided, having a conventional construction according to the teaching of U.S. Pat. No. 3,260,076 and as is now commercially available. Thus, the thermal bar 11 may have a steel burner pipe 13, within which is disposed a packing of a plurality of steel rods or wires 17 with or without an additional central aluminum alloy accelerator rod 15.

The thermal bar 11 is threadedly removably secured to a connecting member 43 which in turn is threadedly secured to a feeder pipe 41. Feeder pipe 41 is slidable within a sleeve bushing 39 which is itself pinned as by transverse securing pins 37 to a reduced diameter neck 35 of a shroud/shield 31. Shroud/shield 31 has an enlarged diameter outer annular wall 33 which is open at its forward end for engagement with a target T.

A window 34 may be formed in the rear laterally extending wall of shroud/shield 31, with a heat-resistant glass **34*a* being secured in place thereover as by a suitable securing ring 34*c*** in order to enable the operator to view the burning area and/or to determine that burning is taking place.

Suitably secured on the forward end of the burner pipe 13 is an igniter unit 21. A suitable igniter unit is disclosed in my copending application Ser. No. 628,008, to which reference is made for a more detailed discussion thereof. In the illustrative embodiment the igniter unit 21 is threadedly secured onto the burner pipe 13. An electrical ignition element, such as a plastic-coated M-100 Electric Match, or an electric squib, or other similar electrically ignitable ignition element having an exothermic ignition component therein, is disposed in the base of the cup-shaped cavity of the plastic body of igniter 21, and connects through electrical connecting leads 121 to a burner 137 or other EMF source, and a switch 135. A reverse flow passageway is formed in the threaded section of the plastic body 103, as by a longitudinal slot 103*s* cut or formed along and beyond the threaded zone of igniter body 103 so as to extend from within the base of the cup chamber and along the outer wall of the burner pipe 113, to the external atmosphere. The electrical connecting leads 121 may be suitably retained against the outer wall of igniter unit 121 as by taping such in place. Connecting leads 121 may suitably be extended through the annular wall 33, as by passage through an opening formed in such annular wall, and sealed in place as by a plastic seal or the like, as generally indicated at 123.

Ignition of the thermal bar 11 is effected by passage of oxygen under pressure from a suitable source through feeder pipe 41 and thermal bar 11 to the igniter unit 21 and out through reverse flow gas passageway slot 103*s*, and thereupon closing switch 135 to apply current through electrical ignition arrangement 105, to thereby cause the plastic cup 103 to be ignited by ignition of ignition element 105, the high temperature burning of which cup 103 will, in the presence of the oxygen therepast, subsequently after approximately two or three seconds of burning, effect ignition of the adjacent forward end of the thermal bar 11, with its burner pipe 13 and metallic rods 15, 17. The continued burning of the thermal bar is effected by continued passage of oxygen under pressure through feeder pipe 41 and gas passageways 19 formed by the rods 15, 17 and within burner pipe 13 of thermal bar 11, to the forward burning end of the thermal bar 11.

The thermal bar 11 and igniter unit 21 are initially pressed against the target T, and the thermal bar is fed theretoward, through the medium of a hand holder/feeder 61. In addition, the shroud/shield 31 is resiliently pressed against the target T, both initially and as the thermal bar 11 is subsequently fed forwardly to the zone of burning of the target. If desired for a given use, the hand holder/feeder may be employed without shroud/shield 31 and its associated drive spring 45, although it will be appreciated that the function of the shroud/shield will be omitted or required to be otherwise provided in such case.

Hand holder/feeder 61 includes a tubular housing 63 having a pusher bushing 65 threadly secured therein at the forward end thereof, and which pusher bushing 65 has a central bore formed therein slidably engagable with and along the feeder pipe 41. A sleeve bushing 69 is fixed within the rear end of the tube housing 63, as by the medium of transverse securing pins 69*a*, the sleeve bushing 69 being slidably engagable about the feeder pipe 41, to thereby enable the hand holder feeder to be moved forwardly along the feeder pipe 41. A sleeve bushing 67 is pinned to the feeder pipe 41 within the confines of tubular housing 63 and immediately rearward of the pusher bushing 65, as through the medium of transverse securing pins 67*a*. A current compression spring 66 extends about the feeder pipe 41 and within tubular housing 63, between the forward end of sleeve bushing 69 and the rear end of sleeve bushing 67. The hand holder feeder 61 may be provided with a handle 63*a* by which one may suitably hold and maneuver the entire assembly, including hand holder/feeder 61, feeder pipe 41 and thermal bar 11 with its surrounding shroud/shield 31.

A shroud/shield drive spring is provided in the form of a coil compression spring 45 which extends between the forward end of pusher bushing 65 and the rear end of shroud/shield bushing 39.

Feeder pipe 41 may be suitably connected to an oxygen supply line 53 as through the medium of a connecting nipple 51 having a threaded interconnection 41*a* formed between the connecting nipple 51 and the feeder pipe 41.

In operation, the operator will press the handle 63*a* forwardly toward the target T, which will exert a forward pressure on the pusher bushing 65 as well as the feeder pipe sleeve bushing 67, respectively through shroud/shield drive spring 45 and thermal bar feed spring 66. The operator may thereupon, or theretofore if so desired, close the switch 35 to initiate ignition and burning of the electrical ignition element 105 and plastic igniter cup 103, while oxygen is supplied through supply line 53, feeder pipe 41, and thermal bar burner pipe 13 with its gas passageways 19, to and through igniter unit 21 and its reverse flow gas passage restricting slots 103*s*. Upon ignition and burning of the forward end of thermal bar 11 a target hole TH will begin to be formed in the target T, as generally indicated in FIG. 2, and the operator will continue to press forwardly on the handle 63*a* to thereby resiliently bias both the thermal bar 11 and shroud/shield 31 forwardly toward the target T for close continued interengagement by the shroud/shield with the target T, and succeeding burning of the target T by the succeeding incrementally forward movement of thermal bar 11 toward the bottom of the succeedingly deeper target hole TH. Upon completion of the formation of the target hole or such other burning as may be desired in the target T extinguishment of thermal bar may be effected by cutting off the oxygen supply through oxygen supply line 53.

A new thermal bar 11 may be secured in place as necessary, by unscrewing the thermal bar 11 from securing nipple 43 and screwing a new thermal bar into the forward end securing nipple 43.

Figure 3:
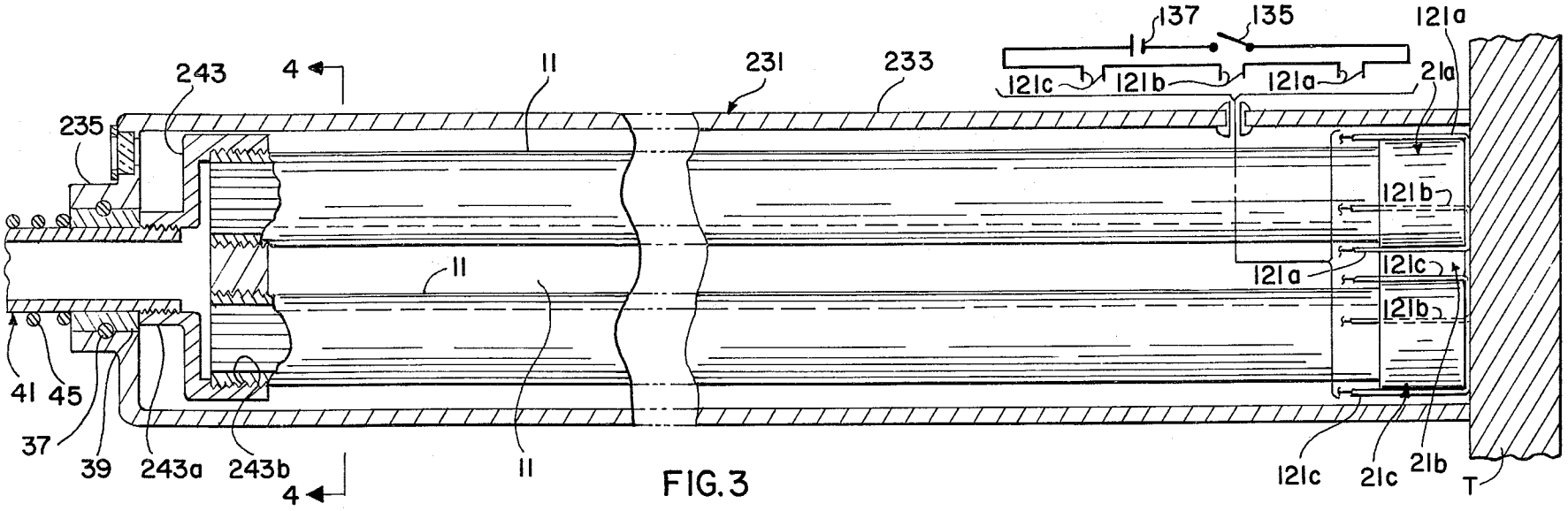
FIG. 3 is a longitudinal section view illustrating a modified thermal bar cluster arrangement in accordance with the invention.
Figure 4:
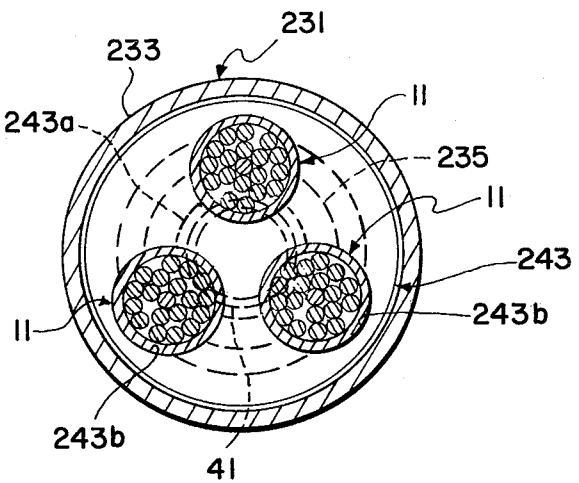
FIG. 4 is a cross-section view taken on Line 4—4 of FIG. 3.

In FIG. 3 there is illustrated a modified embodiment employing a cluster of thermal bars 11, which in the illustrative embodiment are three in number and arranged at equal spacing about a longitudinal central axis within a shroud 231. The thermal bars 11 are threadedly removably secured within corresponding threaded openings 243*b* formed in the forward wall of securing nipple 243 which forms a common securing, supporting and gas feed manifold unit, and connect therethrough with the hollow interior of feeder pipe 41, which may be of the same construction as the feeder pipe of FIGS. 1 and 2, with the corresponding remaining hand holder/feeder arrangement, etc. of FIG. 1 being provided. The reduced diameter neck 235 of shroud 231 is similarly fixed, as by securing pin 37, to a shroud sleeve bushing 39 which is slidable along feeder pipe 41 under the influence of shroud/shield drive compression spring 45.

The three thermal bars 11 may be suitably provided with respective igniters 21*a*, 21*b*, 21*c*, similar to the igniter 21 of FIG. 1, and being connected in series with a battery or other EMF source 137 and switch 135 for simultaneous ignition by the operator. This cluster bar arrangement will enable the cutting of a substantially larger target hole in one single pass, as compared to the single space cutting of the single thermal bar 11 of FIG. 1. Various other quantities of thermal bars may be employed as desired in suitable cluster configuration in order to provide a desired cutting hole zone.

Figure 5:
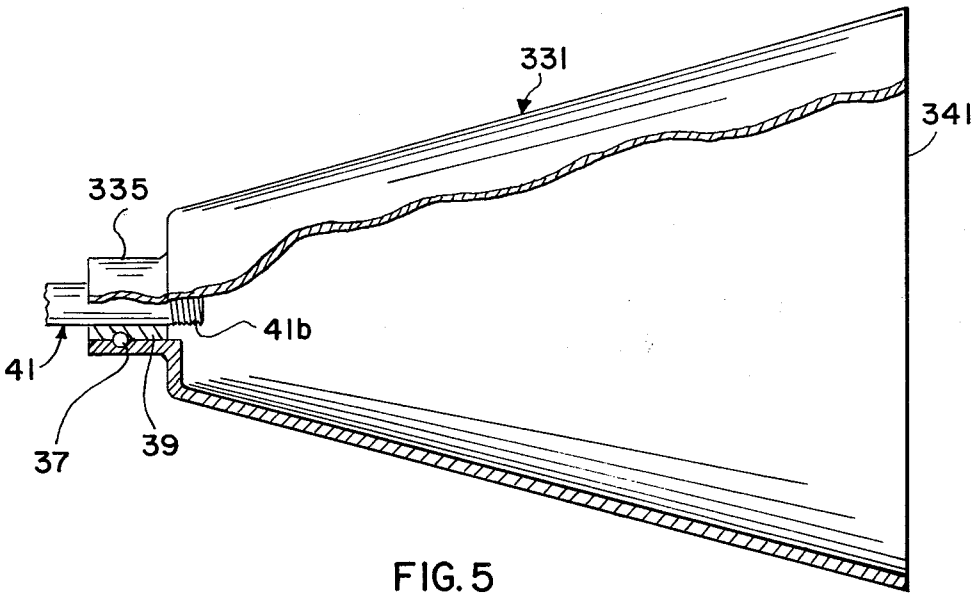
FIG. 5 is a modified shroud/shield which may be employed in many of the shields of either FIGS. 1 or 3.

In FIG. 5 there is illustrated a modified shroud/shield 331, which is flared outwardly from its reduced neck portion 335, which in turn has a shroud sleeve bushing 39 pinned to the shroud as at 37 and which slidably rides on feeder pipe 41, as in the preceding embodiments. The forward end of feeder pipe 41 may be threaded as idicated at 41*b*, as in the preceding embodiments, for securement to a securing nipple, such as securing nipples 43 and 243 of FIGS. 1 and 3 respectively, to thereby enable removable securing of thermal bars 11 thereto. The flared shroud/shield 331 of this embodiment enables the open forward end of the shroud/shield to be further spaced from the zone of cutting by the burning end of the thermal bar or bars 11, with smaller weight and size than with a similar larger diameter along the entire length of the shroud/shield.

While the invention has been illustrated and described with respect to several illustrative embodiments, it will be apparent that various modifications and improvements may be made without departing from the scope and spirit of the invention. Accordingly, the invention is not to be limited to the illustrative embodiments but only by the scope of the appended claims.

I claim:

1. A cutting torch arrangement comprising a plurality of longitudinally extending thermal bars each comprising a burner pipe having combustible rod-like elements extending along a length thereof, with longitudinal gas passageways formed therebetween for feeding of oxygen gas along the interior of said pipe and enabling igniting and burning of one end of said thermal pipe, and composite support means compositely supporting said thermal bars at one end thereof remote from the opposite end thereof and having gas flow passageway means formed therein connecting with the interior of each of said thermal bars, said composite support means comprising a common securing, supporting and gas feed manifold having a common gas feed opening therein and multiple thermal bar-supporting and gas feeding openings for secured supporting engagement with corresponding respective ones of a plurality of thermal bars, and a common gas manifold chamber formed within said securing, supporting and gas feed manifold and connecting in gas flow connecting relation between said common gas feed opening and said multiple thermal bar-supporting and gas feeding openings is said manifold.

2. A cutting torch arrangement according to claim 1, and igniting means disposed in secured relation onto said opposite end of said burner pipes.

3. A cutting torch arrangement according to claim 2, said igniting means for each of said thermal bars comprising a cup-shaped member formed of combustible material, and means for igniting said combustible material.

4. A cutting torch arrangement according to claim 3, said means for igniting said combustible material comprising an electrical ignition circuit common to all of said cup-shaped members, and including individual intermediate ignition elements disposed at each said cup-shaped member.

5. A cutting torch arrangement according to claim 4, said electrical ignition circuit including a common electrical source and parallel circuit connections from said common electrical source to each of said individual intermediate ignition elements.

6. A cutting torch arrangement according to claim 4, said individual intermediate ignition elements each including a high resistance section within a mass of exothermic ignition compound.

7. A cutting torch arrangement according to claim 1, said common securing, supporting and gas feed manifold comprising an integral nipple, said multiple thermal bar supporting and gas feed openings being formed by spaced threaded openings formed in said nipple and connecting in gas flow relation with said manifold chamber.

8. A cutting torch arrangement according to claim 7, said nipple having a threaded connection thereon in the zone of said common gas feed opening for securement to a common gas feed line.

9. A cutting torch arrangement according to claim 8, said threaded connection being formed within said common gas feed opening in said manifold nipple.

10. A cutting torch arrangement according to claim 1, said multiple thermal bar supporting and gas feeding openings being spaced in a cluster about an imaginary line extending through the center of said common gas feed opening.

11. A cutting torch arrangement according to claim 10, said cluster of multiple thermal bar supporting and gas feed openings including openings radially spaced from said imaginary center line extending through said common gas feed opening, said radially spaced openings being also angularly spaced apart in at least three angularly spaced portions about said common center line.

* * * * *

UNITED STATES PATENT AND TRADEMARK OFFICE

CERTIFICATE OF CORRECTION

PATENT NO. : 4,050,680

DATED : September 27, 1977

INVENTOR(S) : Patrick E. Sweeney

It is certified that error appears in the above-identified patent and that said Letters Patent are hereby corrected as shown below:

Column 2, Line 13, Change "large" to ---larger---,
Column 2, Line 56, after "suitable" insert ---such---,
Column 2, Line 66, after "igniter" insert ---unit---.
Column 3, Line 33, after "holder/" delete "-",
Column 3, Line 38, after "shroud/" delete "-".
Column 3, Line 40, after "shroud/" delete "-".
Column 4, Line 17, change "slots" to ---slot---,
Column 4, Line 47, after "pipe" insert ---41---.
Column 5, Line 3, change "idi-" to ---indi- ---,
Column 5, Line 49, change "is" to ---in---.
Column 6, Line 2, after "of" insert ---each of---.

Signed and Sealed this

*Twelfth* Day of *May 1981*

[SEAL]

*Attest:*

RENE D. TEGTMEYER

*Attesting Officer* *Acting Commissioner of Patents and Trademarks*